US005966147A

United States Patent [19]

Matsui

[11] Patent Number: 5,966,147

[45] **Date of Patent: *Oct. 12, 1999**

[54] RECORDING APPARATUS HAVING CARRIAGE SELECTIVELY ENGAGEABLE WITH DRIVE BELT

[75] Inventor: Shinya Matsui, Tokyo, Japan

[73] Assignee: Canon Kabushiki Kaisha, Tokyo, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/777,589

[22] Filed: Dec. 31, 1996

[30] Foreign Application Priority Data

Jan. 11, 1996 [JP] Japan ..... 8-020424

[51] Int. Cl.[6] ..... B41J 00/23

[52] U.S. Cl. ..... 347/37

[58] Field of Search ..... 347/49, 37, 32; 400/319, 334, 335, 357, 356, 320, 352

[56] References Cited

U.S. PATENT DOCUMENTS 5,482,388 1/1996 Harada .
5,611,632 3/1997 Hiramatsu et al. ..... 347/37

FOREIGN PATENT DOCUMENTS 57-195677 12/1982 Japan .
2-30573 1/1990 Japan .
2-30574 1/1990 Japan .
6-179279 6/1994 Japan .

*Primary Examiner*—N. Le
*Assistant Examiner*—Thien Tran
*Attorney, Agent, or Firm*—Fitzpatrick, Cella, Harper & Scinto

[57] ABSTRACT

A recording apparatus that records on a recording medium by use of a recording head mounted on a serially movable carriage includes an ultrasonic motor for generating the driving power that enables the carriage to move serially, a driving mechanism to move the carriage serially, a driving power transmission mechanism to transmit the driving power from the ultrasonic motor to the carriage, and an intermittent mechanism to selectively permit the transmission of the driving power from the ultrasonic motor to the carriage. With the structure thus arranged, it is possible to manually move the carriage with ease to facilitate the execution of a jamming sheet removal operation or the like even if the holding torque of the ultrasonic motor is extremely high, thus preventing any possible damages that may take place on the unit that couples the carriage with the power transmission mechanism.

7 Claims, 5 Drawing Sheets

RECORDING APPARATUS HAVING CARRIAGE SELECTIVELY ENGAGEABLE WITH DRIVE BELT

BACKGROUND OF THE INVENTION

1. Field of the Invention

The present invention relates to a recording apparatus that records by recording means mounted on a carriage.

2. Related Background Art

Conventionally, a recording apparatus of a serial type that records on a recording medium by causing its recording head to travel (to execute the main scans) comprises a carriage that mounts the recording head on it to reciprocate (to execute the main scans); a guide unit that guides the carriage to reciprocate; a carriage driving motor (referred to as a CR motor) that enables the carriage to execute the main scans; and a power transmission mechanism formed by pulleys, a transmission belt, and others that transmits the driving power of the CR motor to the carriage.

For an apparatus of the kind, it is necessary to suspend recording once if a clogging (jamming) of a recording sheet (a recording medium) takes place during recording, and then, after such clogged sheet is removed, the recording is resumed. In this respect, if the carriage comes to a stop in the recording area, that is, on the recording sheet at that time, a procedure should be taken so that the carriage is allowed to move outside the recording sheet, at first, and then, the clogged recording sheet is removed.

Meanwhile, as the CR motor, a stepping motor or a DC motor is generally used. The stepping motor has a property that its holding torque is extremely small when it is not excited. Also, the DC motor has a property that its holding torque is extremely small, because it is not structured to effectuate any holding. Therefore, the recording apparatus that uses either a stepping motor or a DC motor as its CR motor makes it easier to move the carriage by the application of a small force.

However, if an ultrasonic motor (hereinafter referred to as a USM) is used as a carriage driving motor (CR motor) for the conventional recording apparatus, there is a problem that the carriage cannot be moved easily by a manual operation, because the rotor and stator of a USM are in contact under pressure, which results in a greater holding torque as compared with the stepping motor or the DC motor.

In other words, since the holding torque of the USM is great, the USM itself does not move even if it is intended to manually move the carriage provided for the recording apparatus that uses the ultrasonic motor as its CR motor. As a result, a problem is encountered that the coupling portion between the carriage and the transmission belt is damaged, the belt is broken, or the pulley shaft is deformed, among other possible damages.

SUMMARY OF THE INVENTION

The present invention is designed in consideration of these technical problems. It is an object of the invention to provide a recording apparatus, the carriage of which is made manually movable with ease even if an ultrasonic motor is used as its carriage driving motor.

It is another object of the invention to provide a recording apparatus that records on a recording medium by recording means mounted on the carriage thereof, which uses an ultrasonic motor as a source of driving power for the reciprocation of the carriage, with the provision of means for intermitting the transmission of the driving power from the ultrasonic motor to the carriage.

It is still another object of the invention to provide a recording apparatus that records on a recording medium by use of a recording head mounted on a serially movable carriage, including the following:

an ultrasonic motor for generating the driving power that enables the carriage to move serially;

a driving mechanism to move the carriage serially;

a driving power transmission mechanism to transmit the driving power from the ultrasonic motor to the carriage; and an intermittent mechanism to intermit the transmission of the driving power from the ultrasonic motor to the carriage.

It is a further object of the invention to provide a recording apparatus that records on a recording medium by use of a recording head mounted on a serially movable carriage, which includes an ultrasonic motor for generating the driving power that enables the carriage to move serially; a driving mechanism to move the carriage serially; a driving power transmission mechanism to transmit the driving power from the ultrasonic motor to the carriage; and an intermittent mechanism to intermit the transmission of the driving power from the ultrasonic motor to the carriage, this intermittent mechanism being provided for the carriage to intermit the driving power between the carriage and the driving power transmission mechanism.

It is still a further object of the invention to provide a recording apparatus that records on a recording medium by use of a recording head mounted on a serially movable carriage, which includes an ultrasonic motor for generating the driving power that enables the carriage to move serially; a driving mechanism to move the carriage serially; a driving power transmission mechanism to transmit the driving power from the ultrasonic motor to the carriage; and an intermittent mechanism to intermit the transmission of the driving power from the ultrasonic motor to the carriage, this intermittent mechanism being provided for the driving power transmission mechanism to intermit the driving power in the interior of the driving power transmission mechanism.

It is another object of the invention to provide a recording apparatus that records on a recording medium by use of a recording head mounted on a serially movable carriage, which includes an ultrasonic motor for generating the driving power that enables the carriage to move serially; a driving mechanism to move the carriage serially, this driving mechanism being provided with a driving power transmission line material to transmit the driving power from the ultrasonic motor to the carriage; and a synchronized driving intermittent mechanism provided for the carriage, which can be shifted to a position to synchronize the driving of the carriage and the driving power transmission line material by fixing the carriage to the driving power transmission line material, and back to a position to release the synchronized driving of the carriage and the driving power transmission line material by releasing the fixation of the carriage to the driving power transmission line material.

It is another object of the invention to provide a recording apparatus that records on a recording medium by use of a recording head mounted on a serially movable carriage, which includes an ultrasonic motor for generating the driving power that enables the carriage to move serially; a driving mechanism to move the carriage serially, this driving mechanism being provided with a driving power transmission line material to transmit the driving power from the ultrasonic motor to the carriage; and a synchronized driving intermittent mechanism provided for the carriage, which can be shifted to a position to synchronize the driving of the carriage and the driving power transmission line material by fixing the carriage to the driving power transmission line material, and back to a position to release the synchronized driving of the carriage and the driving power transmission line material by releasing the fixation of the carriage to the driving power transmission line material, this synchronized driving intermittent mechanism is provided with members to hold two locations of the driving power transmission line material, and a member to shift the driving power transmission line material between the two locations in the direction to increase the tension exerted on the driving power transmission line material.

Other objectives and advantages besides those discussed above will be apparent to those skilled in the art from the description of a preferred embodiment of the invention which follows. In the description, reference is made to accompanying drawings, which form a part hereof, and which illustrate an example of the invention. Such example, however, is not exhaustive of the various embodiments of the invention, and therefore reference is made to the claims which follow the description for determining the scope of the invention.

DESCRIPTION OF THE PREFERRED EMBODIMENTS

Figure 1:
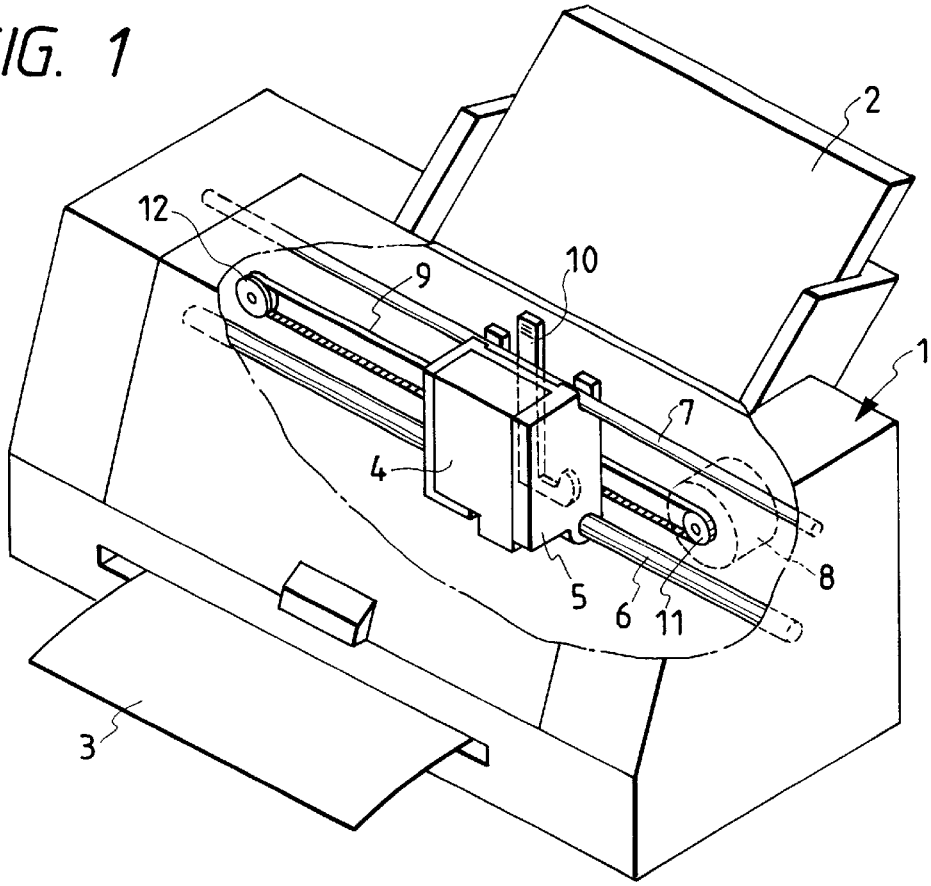
FIG. 1 is a perspective view which schematically shows the brief structure of a first embodiment of the recording apparatus to which the present invention is applicable.

Hereinafter, with reference to the accompanying drawings, the description will be made of the embodiments in accordance with the present invention. Through out each of the drawings, the same reference numerals designate the same or corresponding parts. FIG. 1 is a perspective view which schematically shows the brief structure of a first embodiment of the recording apparatus to which the present invention is applicable, and which represents the features of the present invention in the best mode to understand them.

In FIG. 1, a reference numeral 1 designates a recording apparatus; 2, a recording sheet serving as a recording medium; 3, a recording medium after recording; 4 a recording head serving as recording means; 5, a carriage that reciprocates with the recording head mounted on it; 6, a guide shaft to guide and support the carriage 5; 7, a supporting shaft that guides and supports the carriage 5 in cooperation with the guide shaft 6; 8, an ultrasonic motor (also, referred to as a USM) serving as the carriage driving motor that drives the carriage 5; 9, a driving belt that transmits the driving power of the motor 8 to the carriage 5; 10, a carriage lever (also referred to as a CR lever) installed on the carriage 5; 11, a driving pulley for the driving belt 9; and 12, a driven pulley for the driving belt 9.

In FIG. 1, the driving power of the ultrasonic motor (USM) 8 is transmitted to the driving belt 9 through the driving pulley 11. The driving belt 9 is tensioned by the driving pulley 11 and the driven pulley 12 under a given tension. The carriage lever (CR lever) 10 is to couple the carriage 5 with the driving belt 9 to transmit the driving power or to disengage (release) such coupling.

When recording is performed, the driving power of the USM 8 is transmitted to the driving belt 9 from the driving pulley 11 to enable the carriage 5 to reciprocate along the guide shaft 6 and the supporting shaft 7. In synchronism with the traveling (main scanning) of the carriage 5, the recording head 4 is driven in accordance with image information to execute a one-line recording. When the one-line recording is completed, the recording medium 2 is fed for a one-line portion, that is, a sheet feeding is executed, and then, in synchronism with the main scanning of the carriage 5, the next-line recording is executed. Such recording operation is repeated to complete recording on an entire page intended to be made on the sheet 2. The sheet designated by a reference numeral 3 on which recording has been made is delivered outside the apparatus.

In this respect, the recording head (recording means) 4 is ink jet recording means that discharges ink by utilization of thermal energy. This means is provided with electrothermal transducing elements that generate thermal energy. Also, this recording means utilizes change of pressures made by the development and contraction of each air bubble created by the film boiling generated by the thermal energy applied by each of the electrothermal transducing elements, thus discharging ink from each of the discharge ports for recording.

Figure 11:
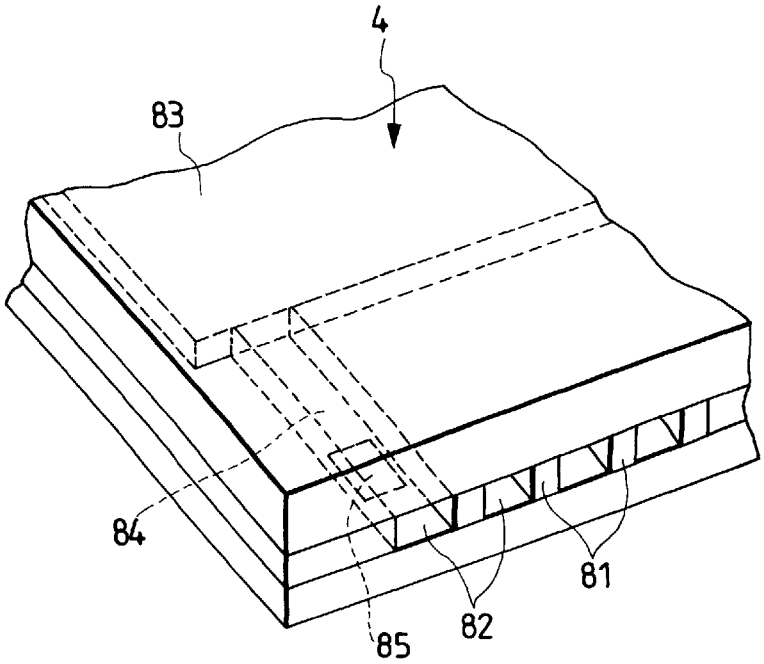
FIG. 11 is a partial perspective view which schematically shows the structure of the ink discharge unit of the recording means represented in FIG. 1.

FIG. 11 is a partial perspective view which schematically shows the structure of the ink discharge unit of ink jet recording means 4. In FIG. 11, on the discharge port surface 81 that faces the recording medium 2 at a given gap (approximately 0.5 to 2.0 mm, for example), a plurality of discharge ports 82 are formed at given pitches. Also, there are arranged electrothermal transducing elements (heat generating resistors or the like) 85 along the wall face of each of liquid paths 84 that conductively connect a common liquid chamber 83 with each of the discharge ports 82.

The ink jet recording means 4 is mounted on the carriage with the positional relationship that the discharge ports 82 are arranged in the direction intersecting the direction in which the carriage 5 scans (travels), and the electrothermal transducing elements 85 are driven (energized) in accordance with the corresponding image signals or discharge signals. Then, film boiling is created in ink in each of the liquid paths, and by the application of pressures thus generated at that time, ink is discharged from each of the discharge ports 82. This constitutes recording means.

Now, in FIG. 1, if by any causes (the user suspends a recording on its way or some errors take place for instance), the recording apparatus should come to a stop before the sheet 2 has been completely delivered outside the apparatus, and if the carriage 5 is suspended at a position (on the sheet 2) in the recording area as illustrated in FIG. 1, it is difficult to execute a Jamming removal process (to draw out the sheet 2).

In such case, the present embodiment is arranged to release (disengage) the coupling between the driving belt 9 and the carriage 5 by operating the carriage lever (CR lever) 10. When the carriage 5 is released from the driving belt 9, it is possible to move the carriage simply and easily by a manual operation even if the holding torque of the USM 8 is extremely great, because the carriage 5 is now disengaged from the USM 8.

Figure 2:
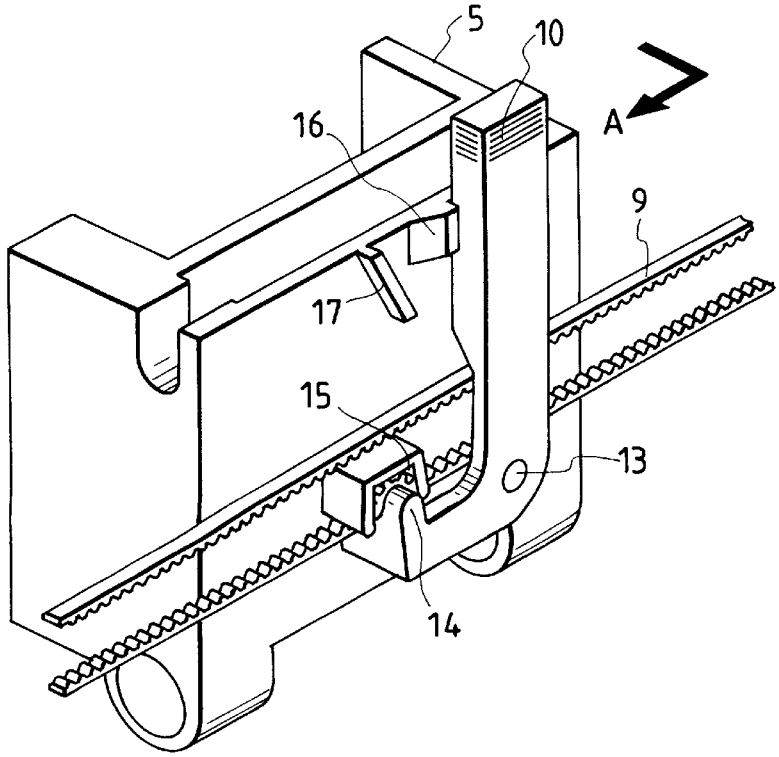
FIG. 2 is a perspective view which schematically shows the details of the carriage lever represented in FIG. 1.

FIG. 2 is a perspective view which schematically shows the details of the carriage lever (CR lever) represented in FIG. 1. In FIG. 2, the CR lever 10 is axially supported to be rotative around the rotational shaft 13 provided for the carriage 5. On the leading end of the lever 10, a belt fixing unit 14 is formed. Meanwhile, there are arranged on the carriage 5 a belt receiving unit 15 to couple the driving belt 9 with the carriage 5 in cooperation with the belt fixing unit 14; a lever hooking 16 to hold the carriage lever 10 in the belt coupling position as shown in FIG. 2; and a lever stopper 17 to regulate the rotational range of the carriage lever 10 when it is released.

In order to release the driving belt 9 from the carriage 5 (that is, to release the synchronism between the driving of the driving belt and the driving movement of the carriage), the CR lever 10 is operated as indicated by an arrow A in the coupling state shown in FIG. 2. Then, the CR lever 10 is disengaged from the lever hooking 16 to rotate centering on the rotational shaft 13 and abut upon the lever stopper 17. Thus, the belt fixing unit 14 arranged on the leading end of the CR lever 10 parts from the belt receiving unit 15 so as to release the driving belt 9, which is nipped between the belt fixing unit 14 and the belt receiving unit 15, and fixed (coupled) to the carriage 5.

Here, the carriage 5 is shifted to a desired position (a position outside the recording area, for example), and the jamming removal process (removal of a jammed sheet or the like) for the sheet 2 is conducted. After the jamming removal process is executed with respect to the sheet 2, the CR lever 10 is operated in the direction opposite to the direction indicated by the arrow A in FIG. 2 so that the leading end of the CR lever 10 advances into the belt receiving unit 15 of the carriage 5. At the same time, the CR lever 10 is hooked on the lever hook 16. In this way, the driving belt 9 is coupled to the carriage 5, and the coupling state shown in FIG. 2 is obtained. The driving power of the ultrasonic motor 8 can be transmitted to the carriage 5. Then, the driving belt 9 and the driving movement of the carriage 5 are again conditioned to be synchronized.

Here, in accordance with the first embodiment shown in FIG. 1 and FIG. 2, the structure is arranged so that the lever operation is manually carried out by the user. However, the structure may be arranged to control the engagement and disengagement between the driving belt 9 and the carriage 5 by driving the belt receiving unit by use of a motor provided for the carriage 5 or to control them between the driving belt 9 and the carriage 5 by means of a solenoid using an electromagnetic force.

Figure 3:
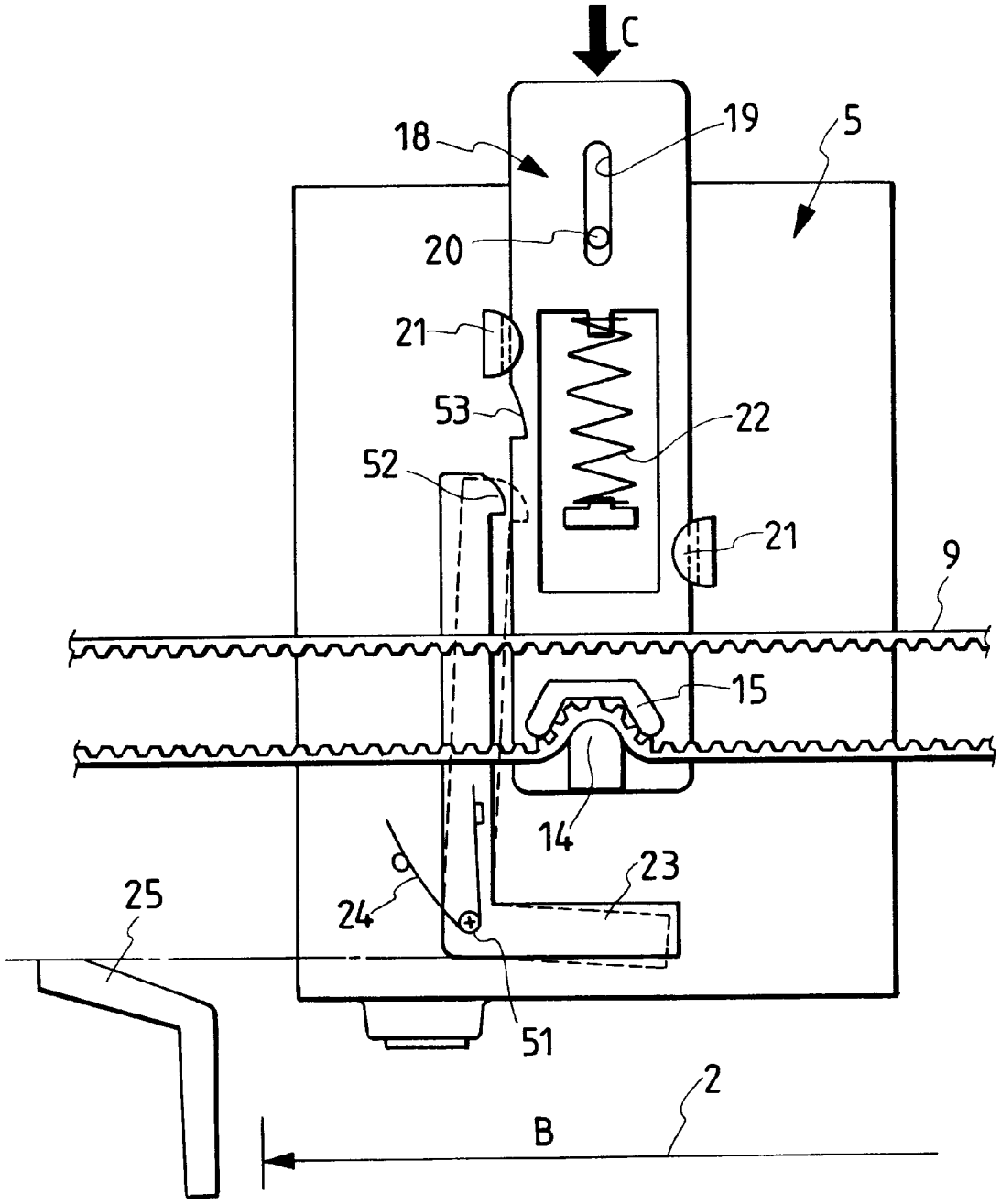
FIG. 3 is a partial front view which schematically shows the principal structure of a second embodiment of the recording apparatus to which the present invention is applicable.

FIG. 3 is a partial front view which schematically shows the principal structure of a second embodiment of the recording apparatus to which the present invention is applicable. In FIG. 3, a reference numeral 18 designates a carriage lever (CR lever) slidably installed on a carriage 5 in the top and bottom directions; 19, a guide groove formed on the CR lever 18; 20, a guide post arranged for the carriage to protrude and engage with the guide groove 19; 21, guides provided for the carriage 5 to guide and support the CR lever 18; and 22, a compression spring arranged between the carriage 5 and the CR lever 18 to bias the CR lever upward.

In FIG. 3, a reference numeral 23 designates a hooking lever to hook the CR lever 18; 24, a twisted coil spring to slidably press the hooking lever 23 to the CR lever 18; and 25, a releasing member to release the hooking lever 23. The hooking lever 23 is rotatively installed around the pivotal shaft 51 arranged for the carriage 5, and the twisted coil spring 24 is fixed to the pivotal shaft 51 in order to bias the hooking lever 23 clockwise as represented in FIG. 3.

Now, the operation will be described. From the state illustrated in FIG. 3, the carriage lever (CR lever) 18 is depressed against the force exerted by the compression spring 22 in the direction shown by an arrow C (downward). Then, the belt fixing unit 14 of the CR lever 18 parts from the belt receiving unit 15 of the carriage 5. The carriage 5 is released from the driving belt 9. The nail 52 at the leading end of the hooking lever 23 is hooked to the notch (cut out portion) 53 of the CR lever 18. In this way, the carriage 5 is held in a state of being released from the driving belt 9.

A reference mark B in FIG. 3 designates the location (range) of a sheet (recording medium) 2. Out of this range of the sheet B (outside the recording area), the releasing member 25 is arranged to release the engagement between the hooking lever 23 and the CR lever 18. In other words, if the carriage 5 that has been released from the driving belt 9 is caused to shift outside the recording area, the lower end of the hooking lever 23 is pressed by the releasing member 25, thus enabling the nail 52 of the hooking lever 23 to part from the notch 53 of the CR lever 18.

When the nail 52 parts from the notch 53, the CR lever 18 is released from the hooking lever 23. At the same time, the CR lever is pressed by means of the spring 22 in the direction opposite to the direction indicated by the arrow C (upward in FIG. 3). Then, the driving belt 9 is nipped between the belt fixing unit 14 and the belt receiving unit 15 (pinched under pressure), and the carriage 5 is coupled to the driving belt 9. Hence, a state is obtained where the driving power of the ultrasonic motor 8 is transmitted to the carriage 5.

With the structure shown in FIG. 3, the driving belt 9 is coupled (fixed) automatically to the carriage without operating the lever and others after the driving belt 9 is released from the carriage 5. Usually, it is only when a sheet jamming removal should be executed that the carriage 5 is manually moved intentionally. Meanwhile, if a sheet jamming removal process is needed, the carriage 5 should be moved to a position outside the sheet area (recording area). Therefore, in accordance with the present embodiment, it is arranged to make it possible to return the CR lever 18 automatically to the position where the coupling of the driving belt is executed, thus effectively eliminating (preventing) any possibility that the CR lever 18 is not returned to the position to effectuate the coupling.

Also, in FIG. 3, the releasing member 25 is fixed to the recording apparatus, but in a case of an ink jet recording apparatus, it may be possible to arrange a structure where the releasing member 25 or an equivalent member is provided for a cap holder, because for this type of recording apparatus, a cap is usually arranged for the protection of the discharge ports of the recording head 4.

Further, for the second embodiment shown in FIG. 3, it may be possible to arrange a structure so that the hooking lever 23, the spring 24, and the releasing member 25 are omitted, and that the carriage is moved while the carriage lever (CR lever) 18 is being depressed (that is, while maintaining the state that carriage 5 is released from the driving belt 9). In this case, if the operational direction of the CR lever 18 (that is, the direction in which the lever is operated toward the releasing position of the driving belt) is made substantially the same as the moving direction of the carriage 5, it is possible to enhance the operativity thereof.

Figure 4:
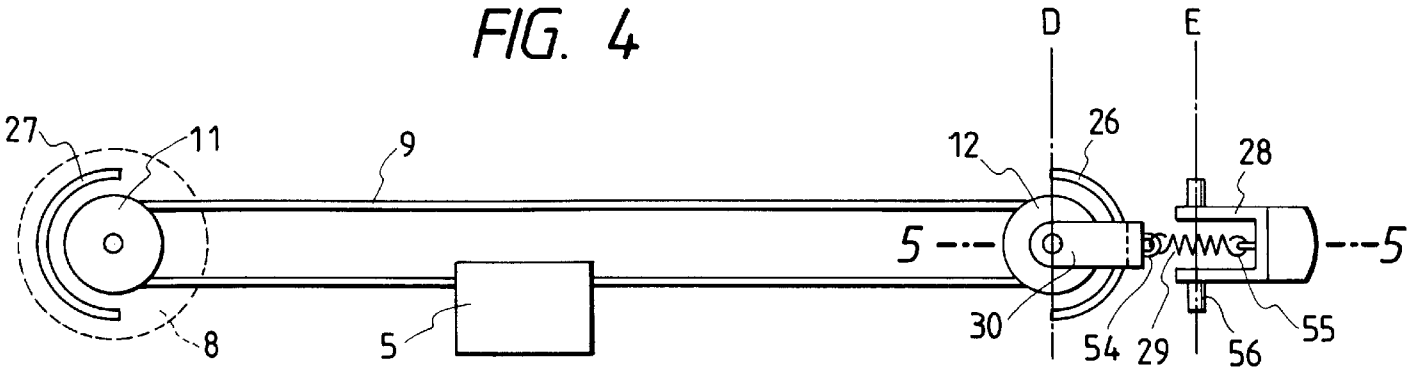
FIG. 4 is a plan view which schematically shows the usual state of the principal structure of a third embodiment of the recording apparatus to which the present invention is applicable.
Figure 6:
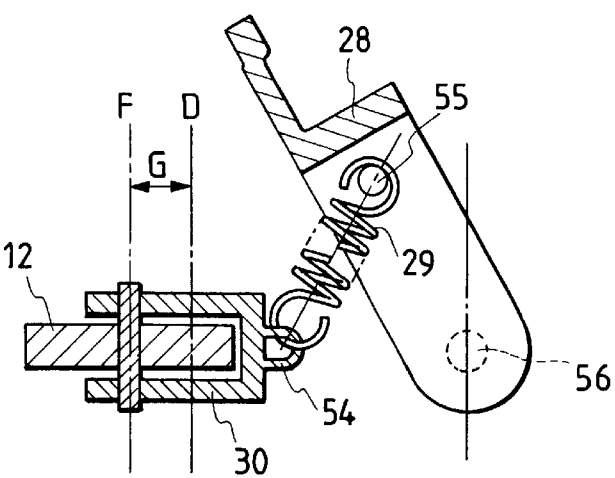
FIG. 6 is a cross-sectional view which shows the same area represented in FIG. 5 in the released state where no driving power is transmitted to the carriage.
Figure 5:
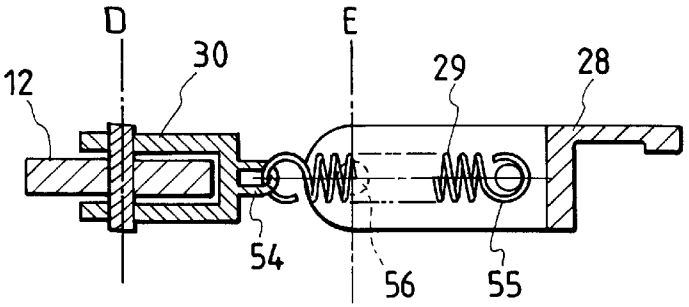
FIG. 5 is a partially sectional view taken along line 5—5 in FIG. 4.

FIG. 4 is a plan view which schematically shows the usual state of the principal part of a third embodiment of the recording apparatus to which the present invention is applicable. FIG. 5 is a partially sectional view taken along line 5—5 in FIG. 4. FIG. 6 is a cross-sectional view which shows the same area as in FIG. 5, but in the released state where no driving power is transmitted to the carriage.

In FIG. 4, a reference numeral 5 designates a carriage that mounts a recording head 4 on it and travels (in the main scanning directions); 8, an ultrasonic motor serving as a carriage driving motor; 9, a driving belt to transmit the driving power of the ultrasonic motor 8 to the carriage; 11, a driving pulley to transmit the driving power of the ultrasonic motor 8 to the driving belt 9; and 12, a driven pulley to give a tension to the driving belt 9.

In FIG. 4, a reference numeral 26 designates a belt guide (a first belt guide) on the driven pulley 12 side; 27, a belt guide (a second belt guide) on the driving pulley 11 side; 28, a tension holder; 29, a tension spring; and 30, a pulley holder to axially support the driven pulley 12.

In FIG. 4, the carriage 5 is connected (coupled) to the driving belt 9. On the circumference of the driving pulley 11, the second belt guide 27 is arranged. The driven pulley 12 is axially supported by the pulley holder 30. The pulley holder 30 is biased in the right-hand direction in FIG. 4 and FIG. 5 by means of the tension spring 29. The other end of the tension spring 29 is connected (hooked) to the tension holder 28.

In accordance with the example shown in FIG. 4, the left end of the tension spring 29 is hooked to the hook 54 of the pulley holder 30 in FIG. 4. The right end of the tension spring 29 is hooked to the hook 55 of the tension holder 28 in FIG. 4. Here, in the usual state represented in FIG. 4 and FIG. 5, the driven pulley 12 is provided with a spring force (tension) by means of the tension spring 29 in the left-hand direction in FIG. 4, thus the driving belt 9 being provided with a tension to that extent. In this respect, the tension holder 28 is axially and rotatively supported around the shaft 56 (axis E) arranged at a fixed position between the hooks 54 and 55.

Also, in the usual state shown in FIG. 4 and FIG. 5, a spring force is exerted on the driven pulley 12 by means of the tension spring 29 in the right-hand direction, thus the driving belt 9 being provided with a tension to that extent. Therefore, the carriage 5 is connected to the ultrasonic motor 8 so as to enable the driving power to be transmitted. Here, with a large holding torque of the ultrasonic motor 8, the carriage 5 cannot move easily even if it is caused to shift manually.

On the other hand, if the tension holder is caused to rotate counterclockwise around the shaft 56 to obtain a released state as shown in FIG. 6, the tension of the tension spring 29 is released (lost). As a result, the pulley holder 30 shifts slightly in the left-hand direction in FIG. 6, and the shaft of the driven pulley 12 shifts to the left from the position D in FIG. 4 and FIG. 5 to the position F in FIG. 6. In other words, the shaft of the driven pulley 12 is caused to shift in the left-hand direction (the direction in which the tension of the driving belt 9 is released) by a distance G in FIG. 6.

In the released state as represented in FIG. 6, the driving belt 9 is relaxed, and the friction driving force (torque transmission force) between the driving belt 9 and the driving pulley 11 is lost. Therefore, the carriage 5 can be easily moved even by a manual operation. In FIG. 6, the distance G is a distance in which the driven pulley 12 has shifted due to the releasing of the tension of the spring 29. If the driving belt 9 is a flat belt, the carriage 5 can be moved smoothly by defining the value of distance G in this way, provided that the value of distance G is more than the extendable length of the driving belt 9 that may be caused by the provision of the tension spring 29.

Meanwhile, if the driving belt 9 is a toothed belt, it is preferable to define the distance G to be more than the extendable length of the driving belt 9 caused by the provision of the tension spring 29, plus the height of tooth engagement of the toothed belt.

In accordance with the third embodiment shown in FIG. 4, FIG. 5 and FIG. 6, the driving belt 9 slidably moves, while parting from the frictional surfaces of the driving pulley 11 and the driven pulley 12 when the carriage 5 is caused to move as the tension of the driving belt 9 is released. In such a case, if the belt guides 26 and 27 are not provided, the driving belt 9 is deviated from the pulleys 11 and 12, leading to the presence of a drawback that may take place when the released state as shown in FIG. 6 returns to the usual state as shown in FIG. 5.

In accordance with the present embodiment, the first belt guide 26 is arranged on the driving pulley 12 side in particular. Therefore, it is possible to maintain the clearance between the driving pulley 12 and the belt guide 26 constantly, thus preventing the driving belt 9 from being deviated. Likewise, the second belt guide 27 is arranged on the circumference of the driving pulley 11 with a given gap, making it possible to prevent the driving belt 9 from being deviated. In this respect, it is usually practiced to arrange flanges on both sides of the frictional circumference of a pulley. In such a case, if the belt guide 27 is arranged on the inner side between the flanges on the left and right sides of the pulley, it is possible to prevent the driving belt 9 from being deviated more reliably.

Figure 7:
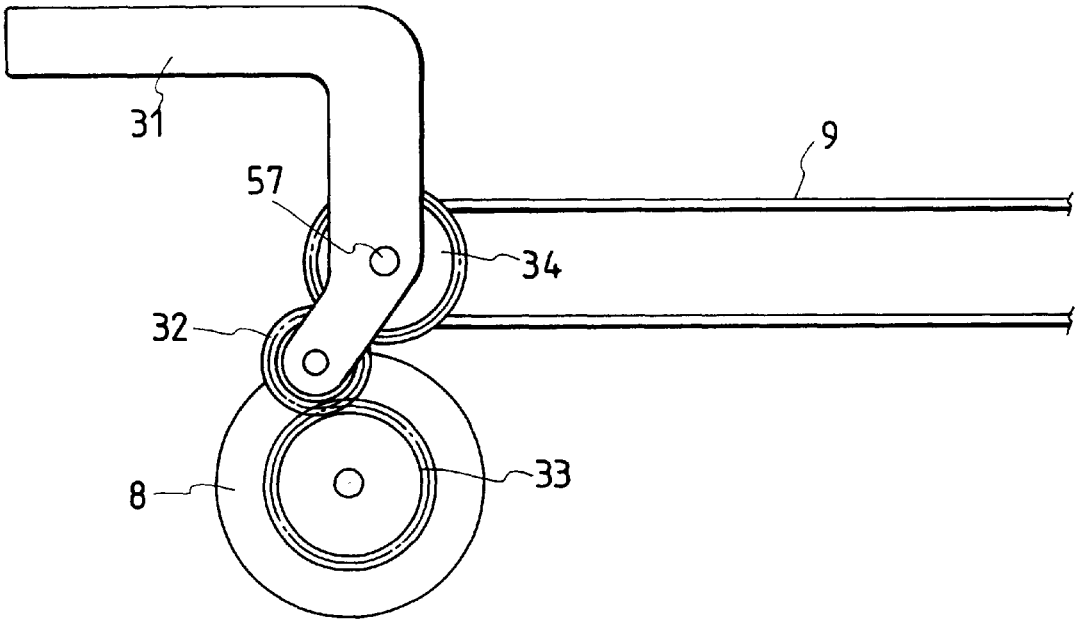
FIG. 7 is a front view which schematically shows the usual state of the principal structure of a fourth embodiment of the recording apparatus to which the present invention is applicable.
Figure 8:
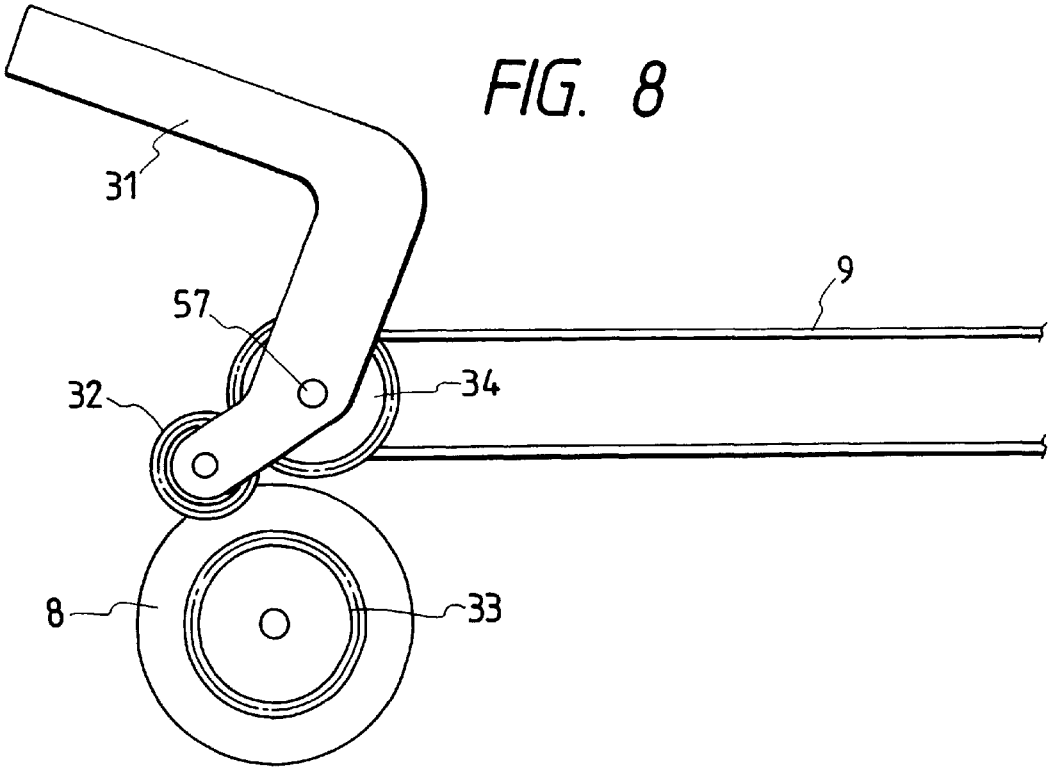
FIG. 8 is a front view which schematically shows the released state of the apparatus represented in FIG. 7.

FIG. 7 is a front view which schematically shows the usual state of the principal structure of a fourth embodiment of the recording apparatus to which the present invention is applicable. FIG. 8 is a front view which schematically shows the released state of the apparatus represented in FIG. 7. In FIG. 7 and FIG. 8, a reference numeral 8 designates an ultrasonic motor serving as a carriage driving motor; 9, a driving belt that transmits the driving power of the ultrasonic motor 8 to a carriage 5; 31, a lever, 32, an idle gear; 33, the output gear of the ultrasonic motor 8; and 34, a geared pulley formed integrally with a driving pulley and a gear.

The lever 31 is rotatively installed around the shaft 57 of the geared pulley 34. The idle gear 32 is rotatively and axially supported on the leading end of the lever 31. The idle gear 32 engages with both the output gear 33 and the geared pulley 34 in the usual state as shown in FIG. 7. Then, the idle gear 32 is arranged to be switchable by the rotation of the lever 31 between the usual state (FIG. 7) where it engages with the output gear 33 and the released state (FIG. 8) where it disengages from the output gear 33.

In accordance with the fourth embodiment shown in FIG. 7 and FIG. 8, the transmission of the driving power to the carriage 5 is arranged to be lost when releasing (disengaging) the power transmission mechanism between the ultrasonic motor 8 and the driving belt 9. In other words, by operating the lever 31, the idle gear 32 is released from the output gear 33 to make it possible to freely shift (move) the driving belt 9 and the carriage 5.

Figure 9:
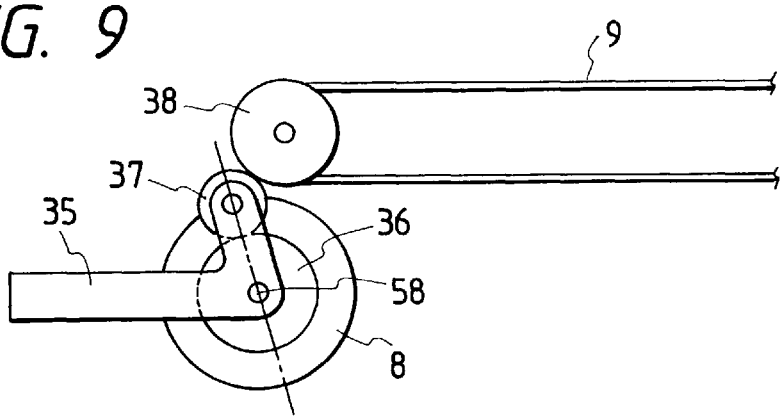
FIG. 9 is a front view which schematically shows the usual state of the principal structure of a fifth embodiment of the recording apparatus to which the present invention is applicable.
Figure 10:
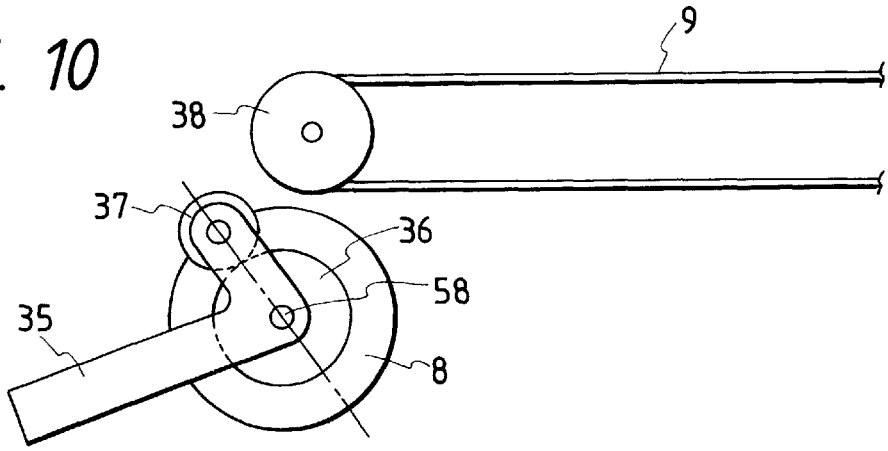
FIG. 10 is a front view which schematically shows the released state of the apparatus represented in FIG. 9.

FIG. 9 is a front view which schematically shows the usual state of the principal structure of a fifth embodiment of the recording apparatus to which the present invention is applicable. FIG. 10 is a front view which schematically shows the released state of the apparatus represented in FIG. 9. In FIG. 9 and FIG. 10, a reference numeral 8 designates an ultrasonic motor serving as a carriage driving motor; 9, a driving belt that transmits the driving power of the ultrasonic motor 8 to a carriage 5; 35, a lever, 36, an output roller of the ultrasonic motor 8; 37, an idle roller; and 38, a rollered pulley formed integrally with an input roller and a driving pulley 11.

The lever 35 is rotatively installed around the shaft 58 of the output roller 36. The idle roller 37 is rotatively and axially supported on the leading end of the lever 35. The idle roller 37 is pressurized to be in contact with the output roller 36 and the rollered pulley 38 in the usual state as shown in FIG. 9 so that it can transmit the driving power to both of them. Then, the idle roller 37 is arranged to be switchable by the rotation of the lever 35 between the usual state (FIG. 9) where it is pressurized to be in contact with the rollered pulley 38 and the released state (FIG. 10) where it parts from the rollered pulley 38.

In accordance with the fifth embodiment shown in FIG. 9 and FIG. 10, the transmission of the driving power to the carriage 5 is arranged to be lost when releasing (parting) the power transmission mechanism between the ultrasonic motor 8 and the driving belt 9. In other words, by operating the lever 35, the idle roller 37 is released from the rollered pulley 38 to make it possible to freely shift (move) the driving belt 9 and the carriage 5.

In this respect, each of the levers 31 and 35 of the fourth embodiment (FIG. 7 and FIG. 8) and the fifth embodiment (FIG. 9 and FIG. 10) may be operated by a motor or a solenoid instead of the manual operation. As described above, in accordance with each of the embodiments, it is possible to obtain a recording apparatus capable of carrying out a required process with ease when a sheet jamming or the like takes place by easily moving a carriage 5 manually or by use of a motive power even when an ultrasonic motor is used as a carriage motor.

Here, for each of the embodiments described above, ink jet recording means is exemplified as recording means (recording head) 4 in the description thereof, but the present invention is equally applicable to other recording means of various kinds such as eletrophotographic type, wire-dot type, thermosensitive type, thermal transfer type, and laser beam type. The invention can demonstrate the same effect when any one of such recording means is adopted. Also, for the embodiments described above, each example is made for the use of only one recording means. However, the present invention is equally applicable to a case where a plurality of recording means are used for recording images in colors or in gradation, and the invention is able to demonstrate the same effect in such cases.

Also, when an ink jet method is used as recording means for the present invention, it is equally applicable to any arrangements of recording head and ink tank, such as a recording unit and an ink tank being arranged separately, but connected by use of an ink supply tube or the like, in addition to an exchangeable head cartridge where an ink discharge unit and an ink retaining unit are integrally formed. The invention is able to demonstrate the same effect in such cases.

Further, when an ink jet recording apparatus is used, the present invention is applicable to an apparatus having recording means (recording head) using electromechanical transducing elements such as piezo elements or the like, but it can demonstrate an excellent effect when applied to an ink jet recording apparatus having recording means adopting a method for discharging ink by utilization of thermal energy, because with such method, it is possible to attain a highly densified recording in high precision.

As is clear from the above description, an ultrasonic motor is used as a driving source to carry out the reciprocation of a carriage for a recording apparatus that records on a recording medium by recording means mounted on the carriage, and then, a structure is arranged to provide means for intermitting the transmission of the driving power of the ultrasonic motor to the carriage in accordance with each of the embodiments described above, thus providing a recording apparatus whose carriage is manually movable with ease to make it easier to remove a jammed sheet or the like even when an ultrasonic motor is used as its carriage driving motor.

What is claimed is:

1. A recording apparatus for recording on a recording medium by using a recording head mounted on a serially movable carriage, said apparatus comprising:

a motor for generating a drive force to move said carriage serially;

a driving mechanism for moving said carriage serially, said driving mechanism comprising a drive force transmitting member for transmitting the drive force from said motor to said carriage;

a lever member rotatably provided on said carriage, a first end of said lever member causing engagement between a predetermined portion of said carriage and said drive force transmitting member as said lever member rotates around a rotation center by a force exerted on a second end of said lever member, and said lever member allowing said carriage to move integrally with said driving force transmitting member driven by the drive force from said motor; and a locking member for locking said second end of said lever member with said carriage in a state that said first end of said lever member is engaged with said predetermined portion of said carriage, said lever member being allowed to rotate with respect to said carriage to release the engagement between said driving force transmitting member and said predetermined portion of said carriage when said second end of said lever member is unlocked from said locking member.

2. An apparatus according to claim 1, wherein said predetermined portion of said carriage supports two portions of said drive force transmitting member and said first end of said lever member displaces said drive force transmitting member between said two portions in a direction to increase a tension of said drive force transmitting member.

3. An apparatus according to claim 2, wherein said recording head is an ink jet recording head for discharging ink through an ink discharge port.

4. An apparatus according to claim 3, wherein said ink jet recording head comprises an electrothermal converting element for generating thermal energy and discharges the ink through the ink discharge port by utilizing the thermal energy.

5. An apparatus according to claim 1, wherein said recording head is an ink jet recording head for discharging ink through an ink discharge port.

6. An apparatus according to claim 5, wherein said ink jet recording head comprises an electrothermal converting element for generating thermal energy and discharges the ink through the ink discharge port by utilizing the thermal energy.

7. A recording apparatus for recording on a recording medium by using a recording head mounted on a serially movable carriage, said apparatus comprising:

an ultrasonic motor for generating a drive force to move said carriage serially;

a driving mechanism for moving said carriage serially, said driving mechanism comprising a drive force transmitting member for transmitting the drive force from said ultrasonic motor to said carriage;

a lever member rotatably provided on said carriage, a first end of said lever member causing engagement between a predetermined portion of said carriage and said drive force transmitting member as said lever member rotates around a rotation center by a force exerted on a second end of said lever member, and said lever member allowing said carriage to move integrally with said driving force transmitting member driven by the drive force from said ultrasonic motor; and a locking member for locking said second end of said lever member with said carriage in a state that said first end of said lever member is engaged with said predetermined portion of said carriage, said lever member being allowed to rotate with respect to said carriage to release the engagement between said driving force transmitting member and said predetermined portion of said carriage when said second end of said lever member is unlocked from said locking member.

* * * * *